US012714247B2

(12) United States Patent
Webb

(10) Patent No.: US 12,714,247 B2
(45) Date of Patent: Aug. 25, 2026

(54) FOOD PROTECTION DEVICE

(71) Applicant: Mary Webb, Killeen, TX (US)

(72) Inventor: Mary Webb, Killeen, TX (US)

( * ) Notice: Subject to any disclaimer, the term of this patent is extended or adjusted under 35 U.S.C. 154(b) by 241 days.

(21) Appl. No.: 18/469,654

(22) Filed: Sep. 19, 2023

(65) Prior Publication Data

US 2024/0099489 A1 Mar. 28, 2024

Related U.S. Application Data

(60) Provisional application No. 63/409,907, filed on Sep. 26, 2022.

(51) Int. Cl.
*A47G 19/26* (2006.01)
*A47G 29/00* (2006.01)

(52) U.S. Cl.
CPC ..... *A47G 19/26* (2013.01); *A47G 29/00* (2013.01)

(58) Field of Classification Search
CPC ..... A67G 19/26; A47G 19/26
See application file for complete search history.

(56) References Cited

U.S. PATENT DOCUMENTS 526,942 A * 10/1894 Rhoads et al. ..... A47C 29/006 135/913
623,445 A * 4/1899 Van Tuyl ..... E04H 15/003 135/96
906,024 A * 12/1908 Hodge ..... E04H 15/02 135/96
907,719 A * 12/1908 Berger ..... A47G 19/26 43/118
2,301,510 A 11/1942 Bolen
2,790,452 A * 4/1957 Dusek ..... E04H 15/04 135/96
3,233,618 A * 2/1966 Ferrier ..... A47B 85/06 135/96
3,307,565 A * 3/1967 Luccarelli ..... A47C 29/006 135/96
3,744,500 A * 7/1973 Briggs ..... A47C 29/006 135/912
4,685,483 A * 8/1987 Balazs ..... A47G 19/26 211/180
5,148,626 A 9/1992 Haake, Sr.
5,311,813 A * 5/1994 Fairbanks ..... A47J 47/005 135/96
5,832,943 A 11/1998 Johnson
6,014,935 A * 1/2000 Willett ..... A47G 11/004 108/50.11
6,499,411 B2 * 12/2002 Brown ..... E04H 15/02 108/26

(Continued)

*Primary Examiner* — Noah Chandler Hawk
(74) *Attorney, Agent, or Firm* — Brennan, Manna & Diamond, LLC

(57) ABSTRACT

A food protection device that covers and protects food served outdoors is disclosed. The food protection device includes a body component that is configured as a flexible, tablecloth-like material with a zipper positioned around a perimeter. The body component can be shaped in a rectangular or circular shape that is placed overtop a table and secured with the zipper. The device protects food on the table from poor weather, insects, and other unfavorable outdoor conditions. Further, each device can be available in multiple designs, sizes, colors, and styles.

8 Claims, 4 Drawing Sheets

(56) References Cited

U.S. PATENT DOCUMENTS

| | | | | |
|---|---|---|---|---|
| 8,069,871 | B2 * | 12/2011 | Schneider | E04H 15/16 135/117 |
| 8,132,585 | B2 * | 3/2012 | Rothweil | A45F 3/52 135/117 |
| 8,899,253 | B1 * | 12/2014 | Watson | E04H 15/40 135/913 |
| 9,388,600 | B2 * | 7/2016 | Leathers | A47B 97/00 |
| 10,058,201 | B2 | 8/2018 | Sparks | |
| 2005/0087459 | A1 | 4/2005 | Slagter | |
| 2006/0081285 | A1 * | 4/2006 | Gomez | A47G 19/26 135/136 |
| 2008/0000398 | A1 | 1/2008 | Barkley | |
| 2011/0100269 | A1 * | 5/2011 | Hull | A47G 11/004 108/90 |
| 2019/0200790 | A1 * | 7/2019 | Rudd | F25D 3/02 |
| 2023/0050856 | A1 * | 2/2023 | Flores | E04H 15/02 |

* cited by examiner

FOOD PROTECTION DEVICE

CROSS-REFERENCE TO RELATED APPLICATION

The present application claims priority to, and the benefit of, U.S. Provisional Application No. 63/409,907, which was filed on Sep. 26, 2022, and is incorporated herein by reference in its entirety.

FIELD OF THE INVENTION

The present invention relates generally to the field of food protection devices. More specifically, the present invention relates to a tablecloth-type cover that can be placed overtop a table to protect food while at a social gathering, party, picnic, barbecue, or any other outdoor event. Accordingly, the present disclosure makes specific reference thereto. Nonetheless, it is to be appreciated that aspects of the present invention are also equally applicable to other like applications, devices, and methods of manufacture.

BACKGROUND

By way of background, this invention relates to improvements in food protection devices. Generally, from backyard barbecues to outdoor picnics, spending time with family or friends is one of the best things in life. Further, bugs and animals can find their way into a meal, creating unsanitary conditions for people trying to eat. Not only is this annoying, but it also leads to food contamination. Additionally, food content can also be ruined by outdoor weather conditions.

Accordingly, food and drinks left on a picnic table easily become contaminated with dirt, debris, and bird droppings; infested by insects or other pests; and blown about by the wind, rained upon, or overheated by the sun. Thus, a user generally needs a means for protecting food and drinks while a family or other group temporarily leaves the table unattended.

Accordingly, there is a demand for an improved food protection device that prevents insects, outdoor debris, or germs from coming into contact with food contents on a user's plate. More particularly, there is a demand for a food protection device that offers a safe and more sanitary experience while eating outdoors.

Therefore, there exists a long-felt need in the art for a food protection device that provides users with a tablecloth-type cover that can be placed overtop a table while at a social gathering, party, picnic, barbecue, or any other outdoor event. There is also a long-felt need in the art for a food protection device that prevents insects, outdoor debris, or germs from coming into contact with food contents on the plate. Further, there is a long-felt need in the art for a food protection device that features a zipper closure to contain the plates of food on the table inside the cover. Moreover, there is a long-felt need in the art for a device that offers a safe and more sanitary experience while eating outdoors. Further, there is a long-felt need in the art for a food protection device that is placed over food plates on a table and secured with a zipper. Finally, there is a long-felt need in the art for a food protection device that is available in multiple designs, sizes, colors, and styles.

The subject matter disclosed and claimed herein, in one embodiment thereof, comprises a food protection device. The device covers and protects food served outdoors. The food protection device comprises a body component that is configured as a flexible, tablecloth-like material with a zipper positioned around a perimeter. The body component can be shaped in a rectangular or circular shape that is placed overtop a table and secured with the zipper. The device protects food on the table from poor weather, insects, and other unfavorable outdoor conditions. Further, each device can be available in multiple designs, sizes, colors, and styles.

In this manner, the food protection device of the present invention accomplishes all of the foregoing objectives and provides users with a device that covers and protects food served outdoors. The device is a tablecloth-like device that is placed over a table. The device can be manufactured in weather resistant materials and insulative materials that retain heat.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a food protection device. The device covers and protects food served outdoors. The food protection device comprises a body component that is configured as a flexible, tablecloth-like material with a zipper positioned around a perimeter. The body component is placed overtop an entire table and secured with the zipper. The device protects food from poor weather, insects, and other unfavorable outdoor conditions. Further, each device can be available in multiple designs, sizes, colors, and styles.

The present invention is a cover for a food plate, multiple food plates, and/or a table, especially an outdoor picnic table, that may be placed over food and drink left on the table, for temporary protection while a family or other group leaves the table unattended. The cover protects the food and drinks from the heat of the sun, wind, rain, falling leaves, bird droppings, insects, or any other pests, debris, or weather. The invention is a food protection device that comprises a body component that is constructed from a flexible waterproof material to cover and protect food served outdoors.

In one embodiment, the food protection device comprises a body component. The body component can be any suitable shape and size as is known in the art. Further, the body component is typically configured in a circular or rectangular shape to match the shape of a table that needs to be protected but can be any suitable shape as is known in the art, depending on the shape and size of the table to be protected and covered. Typically, the body component comprises an exterior surface and an interior surface and can be any suitable dimensions as is known in the art, such that the device is sized to cover a plate of food, multiple plates of food, and/or an entire table surface.

In this embodiment, the body component is made from a pliable material or netting, such as a tablecloth-like material or a sheer cotton material, polyvinyl chloride, nylon, carbon fiber, etc. Further, the pliable material in one embodiment is washable, allowing the food protection device to be washed and reused, as needed. In another embodiment, the pliable material is weather resistant or has a weather resistant coating on the exterior surface to protect the food plate against rain, hail, snow, etc. In yet another embodiment, the pliable material is insulated to retain heat and keep the food on the food plates on the table warm longer.

Further, in one embodiment, the food protection device can also be wind resistant and the perimeter of the body component can comprise small weights, clamp members, or other means for securing the body component to a table surface or to the food plate itself, which prevents the body component from being blown off the food plate during times of high winds and/or storms.

In one embodiment, the body component comprises a zipper component positioned on its perimeter for securing the device around a table. However, the zipper component is not needed and can be replaced with other releasably securing means, such as Velcro, snaps, overlapping flaps, etc.

In one embodiment, the body component is positioned over a food plate, multiple food plates, and/or an entire table surface and secured. In this embodiment, a hem is formed around the perimeter of the body component with two diametrically opposite openings. A continuous draw cord is then contained within the hem. Access to two portions of the draw cord is gained through the openings in the hem. When the draw cord is grasped and pulled taught at these latter portions, the body component is drawn tight around the table and secured via securing the draw cord in place with a spring-loaded lock or cinch component. In another embodiment, the hem contains an elastic cording that encircles the perimeter and acts to secure the body component tightly around the table.

In one embodiment, the exterior surface of the body component comprises at least one pocket that can be any suitable shape and size as is known in the art. The pocket can be sized and shaped to retain a plurality of napkins, plastic cutlery, wet wipes, salt and pepper or ketchup packets, etc. Further, the pocket can be releasably secured shut with a zipper, snaps, Velcro, overlapping flaps, etc.

In one embodiment, the body component is formed from two layers of pliable material secured together (i.e., an outer layer and an inner layer). The layers may be either cloth or plastic, or the outer layer may be a plastic or water-resistant fabric, while the inner layer is a more insulated fabric. In one embodiment, the outer layer comprises a padded material, which adds security to the contents of the table.

In one embodiment, the body component comprises a plurality of rigid members which are positioned on the interior surface. In one embodiment, the rigid members are positioned between the inner and outer layers of the body component. Further, the rigid members can be a set of legs secured to various points of the perimeter. In another embodiment, the rigid members can be arches or ribs secured to the interior surface (i.e., to create a spine), which allows the body component to be supported in an expanded position, away from the food on the table and prevents the body component from contacting the food on the table when in use. Specifically, the body component is supported over the table or food plate by rigid, semicircular ribs which maintain the body component in a curved shape away from the food on the table. Typically, any suitable number, shape, and size of rigid members can be utilized as is known in the art. Furthermore, the rigid members act to provide form and protection for the body component and prevent the body component from contacting the food on the covered table.

In one embodiment, the body component may be manufactured of any suitable flexible waterproof material, including natural or synthetic fabrics, or plastics. Further, the rigid members may be made of any suitable material that is sufficiently rigid to support the body component, including wood, metal or plastic, etc. Additionally, it is preferable that all parts of the invention be made of lightweight materials so that it will be easy to carry.

In one embodiment, the food protection device is available in multiple designs, sizes, colors, and styles. However, typically the body component is limited to three main colors, including red, white, and blue.

In yet another embodiment, the food protection device comprises a plurality of indicia.

In yet another embodiment, a method of protecting food served outdoors is disclosed. The method includes the steps of providing a food protection device comprising a body component with a zipper positioned around the perimeter. The method also comprises positioning the body component overtop a table while at an outdoor event. Further, the method comprises securing the body component with the zipper. Finally, the method comprises protecting the food on the table from insects, outdoor debris, or germs via the food protection device.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
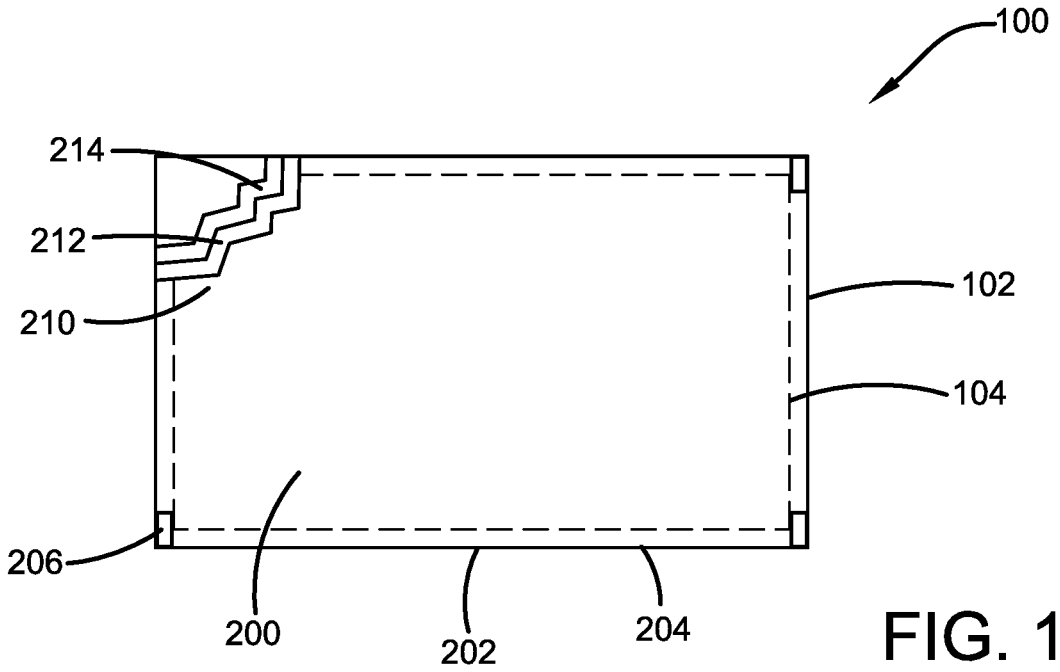
FIG. 1 illustrates a top perspective view of one embodiment of the food protection device of the present invention showing the rectangular configuration of the device in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof.

It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a food protection device that provides users with a tablecloth-type cover that can be placed overtop a table while at a social gathering, party, picnic, barbecue, or any other outdoor event. There is also a long-felt need in the art for a food protection device that prevents insects, outdoor debris, or germs from coming into contact with food contents on the table. Further, there is a long-felt need in the art for a food protection device that features a zipper closure to contain the table inside the cover. Moreover, there is a long-felt need in the art for a device that offers a safe and more sanitary experience while eating outdoors. Further, there is a long-felt need in the art for a food protection device that is placed over a table and secured with a zipper. Finally, there is a long-felt need in the art for a food protection device that is available in multiple designs, sizes, colors, and styles.

The present invention, in one exemplary embodiment, is a novel food protection device. The device covers and protects food served outdoors. The food protection device comprises a body component that is configured as a flexible, tablecloth-like material with a zipper positioned around a perimeter. The body component can be shaped in a rectangular or circular shape that is placed overtop a table and secured with the zipper. The device protects food from poor weather, insects, and other unfavorable outdoor conditions. The present invention also includes a novel method of protecting food served outdoors. The method includes the steps of providing a food protection device comprising a body component with a zipper positioned around the perimeter. The method also comprises positioning the body component overtop a table while at an outdoor event. Further, the method comprises securing the body component with the zipper. Finally, the method comprises protecting the food on the table from insects, outdoor debris, or germs via the food protection device.

Figure 2:
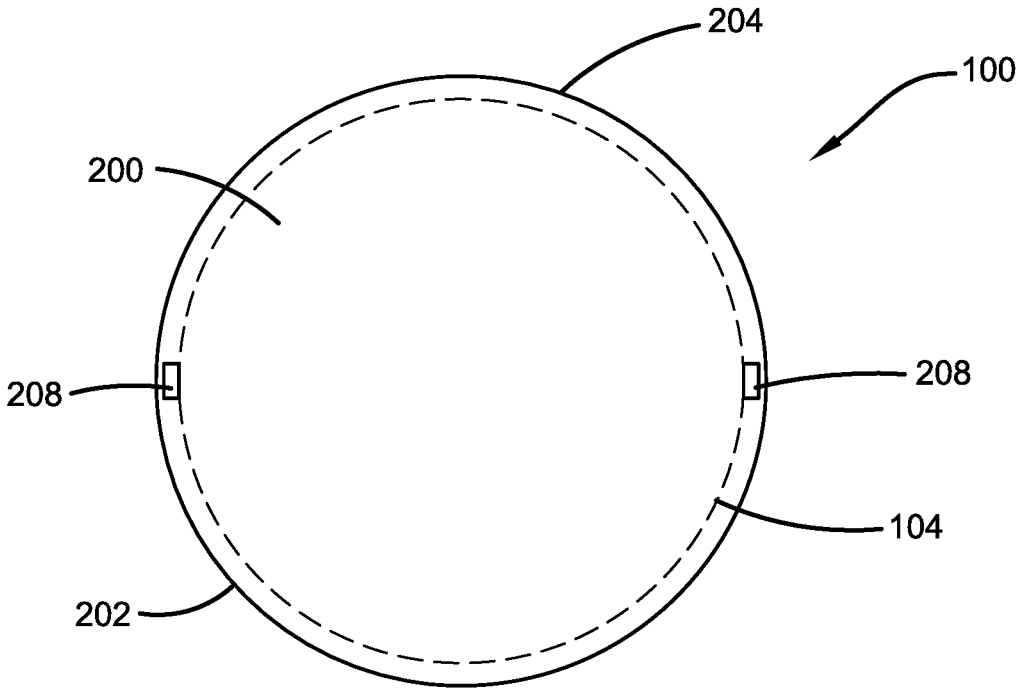
FIG. 2 illustrates a top perspective view of one embodiment of the food protection device of the present invention showing the circular configuration of the device in accordance with the disclosed architecture.

Referring initially to the drawings, FIGS. 1-2 illustrates a perspective view of one embodiment of the food protection device 100 of the present invention. In the present embodiment, the food protection device 100 is an improved food protection device 100 that covers and protects food 106 served outdoors. Specifically, the food protection device 100 comprises a body component 102 with a zipper component 104 for securing the device 100 around a table 110 of food 106. Further, the body component 102 is configured as a flexible, tablecloth-like material which is placed overtop a plate 108 of food 106 or over an entire table 110 and secured with the zipper component 104. The device 100 protects food 106 from poor weather, insects, and other unfavorable outdoor conditions.

Generally, the present invention is a cover device 100 for a food plate 108, multiple food plates 108, and/or a table 110, especially an outdoor picnic table, that may be placed over food 106 and drink left on the table 110, for temporary protection while a family or other group leaves the table 110 unattended. The cover device 100 protects the food 106 and drink from the heat of the sun, wind, rain, falling leaves, bird droppings, insects, or any other pests, debris, or weather. The invention is a food protection device 100 that comprises a body component 102 that is constructed from a flexible waterproof material to cover and protect food 106 served outdoors.

Furthermore, the food protection device 100 comprises a body component 102. The body component 102 can be any suitable shape and size as is known in the art. Further, the body component 102 is typically configured in a circular or rectangular shape to match the shape of a table 110 that needs to be protected but can be any suitable shape as is known in the art, depending on the shape and size of the table 110 to be protected and covered. Typically, the body component 102 comprises an exterior surface 200 and an interior surface 202 and can be any suitable dimensions as is known in the art, such that the device 100 is sized to cover a plate 108 of food 106, multiple plates 108 of food 106, and/or an entire table 110 surface.

Overall, the body component 102 is made from a pliable material or netting, such as a tablecloth-like material or a sheer cotton material, polyvinyl chloride, nylon, carbon fiber, etc. Further, the pliable material in one embodiment is washable, allowing the food protection device 100 to be washed and reused, as needed. In another embodiment, the pliable material is weather resistant or has a weather resistant coating on the exterior surface 200 to protect the table 110 against rain, hail, snow, etc. In yet another embodiment, the pliable material is insulated to retain heat and keep the food 106 on the table 110 warm longer.

In one embodiment, the body component 102 is formed from two layers of pliable material secured together (i.e., an outer layer 210 and an inner layer 212). The layers 210 and 212 may be either cloth or plastic, or the outer layer 210 may be a plastic or water-resistant fabric, while the inner layer 212 is a more insulated fabric. In one embodiment, the outer layer 210 comprises a padded material 214, which adds security to the contents of the table 110.

Further, the food protection device 100 can also be wind resistant and the perimeter 204 of the body component 102 can comprise small weights 206, clamp members 208, or other means for securing the body component 102 to a table 110 surface or to the food plate 108 itself, which prevents the body component 102 from being blown off the food plate 108 during times of high winds and/or storms, or other adverse weather conditions.

Additionally, the body component 102 comprises a zipper component 104 positioned on its perimeter 204 for securing the device 100 around a table 110. Further, the zipper component 104 can be secured at only one area of the perimeter 204, as long as the zipper component 104 allows a user to secure a table 110 within the body component 102. However, the zipper component 104 is not needed and can be replaced with other releasably securing means, such as Velcro, snaps, overlapping flaps, etc., or any other suitable securing means as is known in the art.

In one embodiment, the body component 102 comprises a handle 216 or any other suitable component for a user to easily lift and replace the device 100 on a table 110, as needed.

Figure 3:
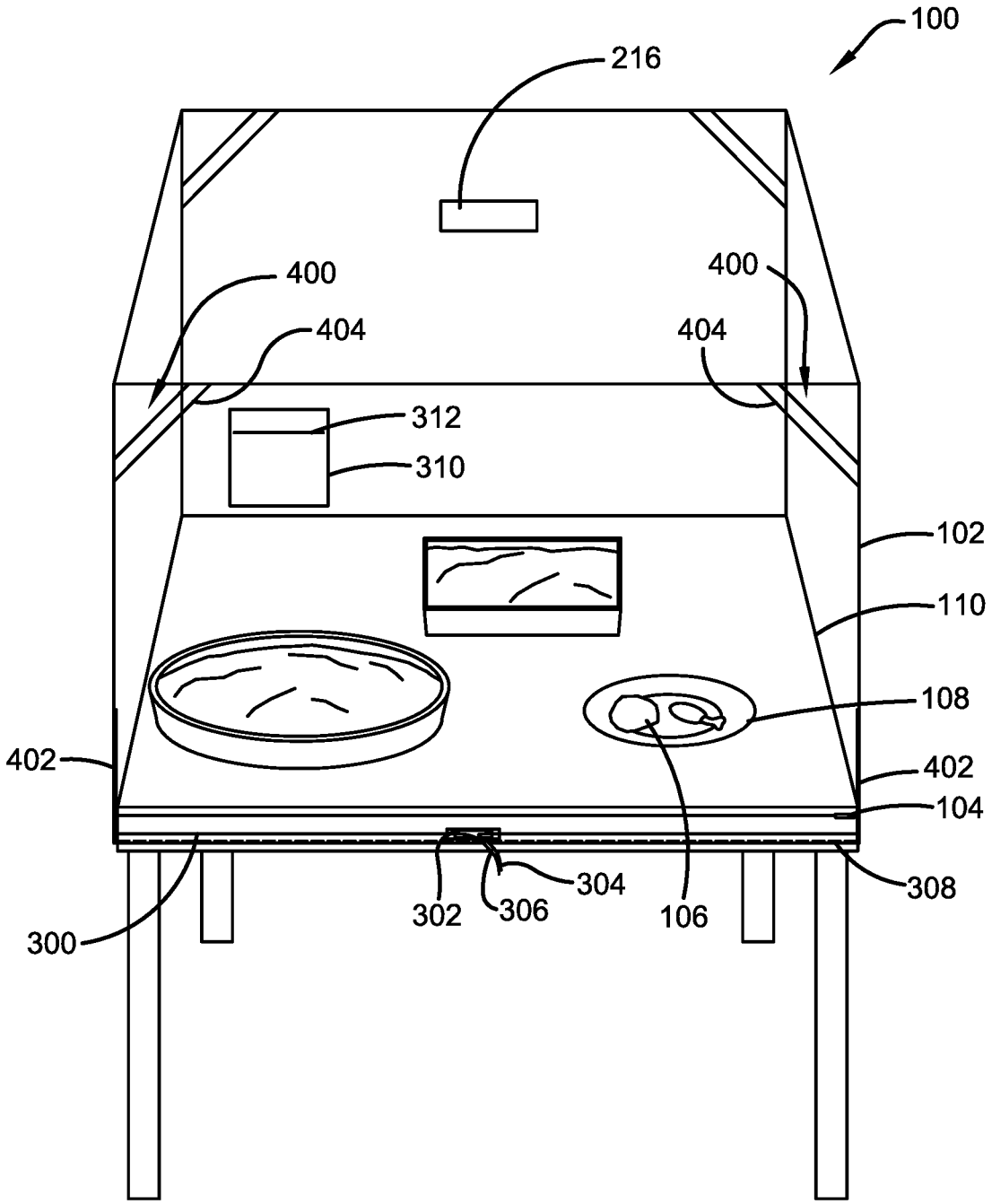
FIG. 3 illustrates a side perspective view of one embodiment of the food protection device of the present invention showing the rectangular configuration of the device in use in accordance with the disclosed architecture.
Figure 4:
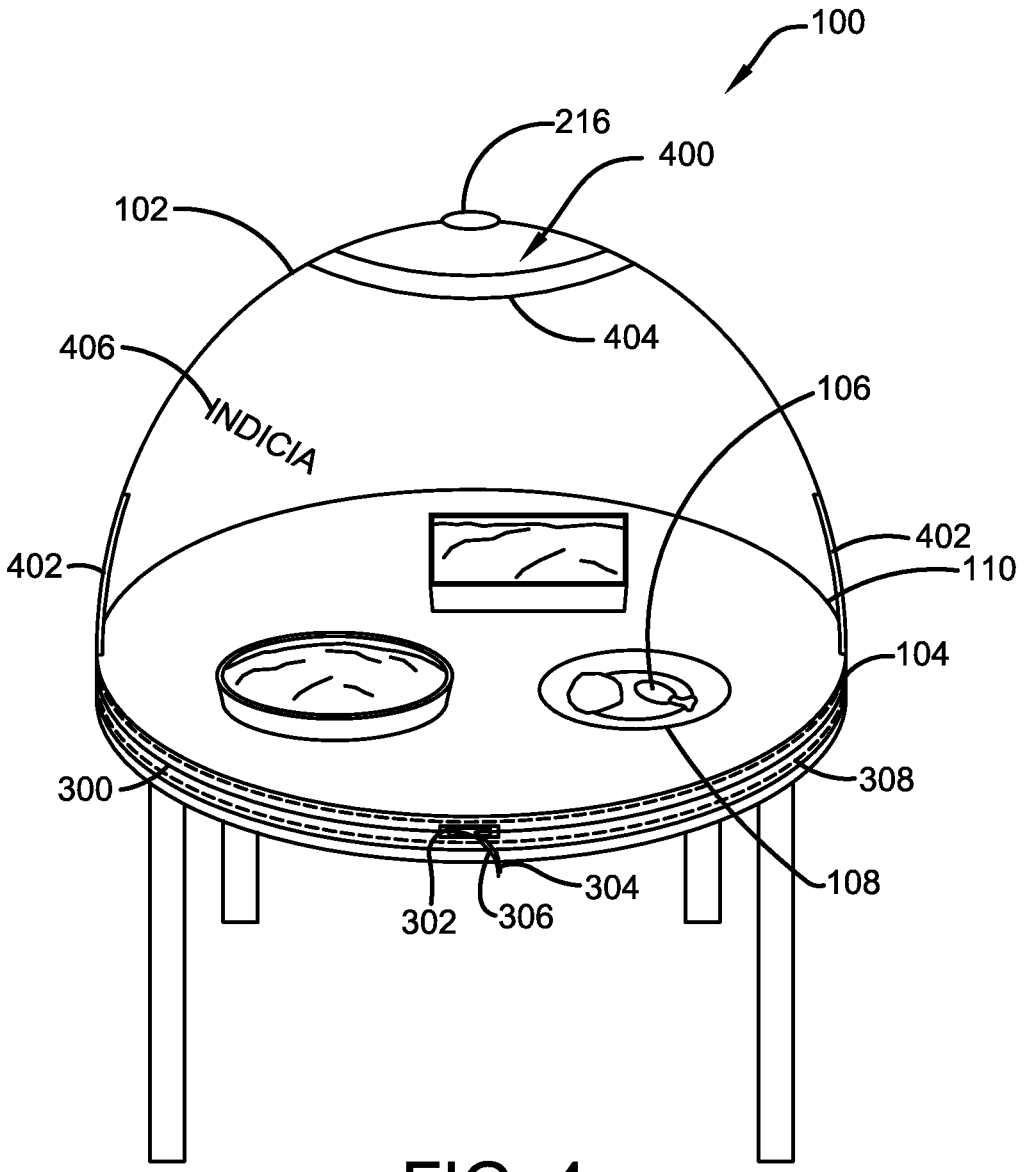
FIG. 4 illustrates a side perspective view of one embodiment of the food protection device of the present invention showing how the circular configuration of the device in use in accordance with the disclosed architecture.

As shown in FIGS. 3-4, the body component 102 is positioned over a food plate 108, multiple food plates 108, and/or an entire table 110 surface and secured. In this embodiment, a hem 300 is formed around the perimeter 204 of the body component 102 with two diametrically opposite openings 302. A continuous draw cord 304 is then contained within the hem 300. Access to two portions of the draw cord 304 is gained through the openings 302 in the hem 300. When the draw cord 304 is grasped and pulled taught at these latter portions, the body component 102 is drawn tight around the table 110 and secured via securing the draw cord 304 in place with a spring-loaded lock or cinch component 306. In another embodiment, the hem 300 contains an elastic cording 308 that encircles the perimeter 204 and acts to secure the body component 102 tightly around the table 110.

Furthermore, the exterior surface 200 of the body component 102 comprises at least one pocket 310 that can be any suitable shape and size as is known in the art. The pocket 310 can be sized and shaped to retain a plurality of napkins, plastic cutlery, wet wipes, salt and pepper or ketchup packets, etc. Further, the pocket 310 can be releasably secured shut with a zipper 312, snaps, Velcro, overlapping flaps, etc.

Generally, the body component 102 comprises a plurality of rigid members 400 which are positioned on the interior surface 202. In one embodiment, the rigid members 400 are positioned between the inner 212 and outer 210 layers of the body component 102. Further, the rigid members 400 can be a set of legs 402 secured to various points of the perimeter 204. In another embodiment, the rigid members 400 can be arches or ribs 404 secured to the interior surface 202 (i.e., to create a spine), which allows the body component 102 to be supported in an expanded position, away from the food 106 on the table 110 and which prevents the body component 102 from contacting the food 106 on the table 110 when in use. Specifically, the body component 102 is supported over the table 110 or food plate 108 by rigid, semicircular ribs 404 which maintain the body component 102 in a curved shape away from the food 106 on the table 110. Typically, any suitable number, shape, and size of rigid members 400 can be utilized as is known in the art. Furthermore, the rigid members 400 act to provide form and protection for the body component 102 and prevent the body component 102 from contacting the food 106 on the table 110.

Furthermore, the body component 102 may be manufactured of any suitable flexible waterproof material, including natural or synthetic fabrics, or plastics, etc. Further, the rigid members 400 may be made of any suitable material that is sufficiently rigid to support the body component 102, including wood, metal or plastic, etc. Additionally, it is preferable that all parts of the invention be made of lightweight materials so that it will be easy to carry.

Generally, the food protection device 100 is available in multiple designs, sizes, colors, and styles. However, typically the body component 102 is limited to three main colors, including red, white, and blue. Overall, the body component 102 comprises various woven materials with any desirable color, pattern, floral decoration, sports team, sporting items, birthday cakes, fur, feathers, beads, etc., or suitable ornamental design as is known in the art for any suitable occasion.

For purposes of the present invention, references to ornamentation or ornamental elements refer to any and all visible characteristics of the exterior surface 200 of the body component 102 discussed herein. These terms may refer to the color, texture, pattern, decoration, or design of the body component 102 exterior surface 200. Also included are physically separate elements, such as beads, stones, buttons, feathers, fur, sporting items, sports team logos, etc., which may be attached to the body component 102. Ornamentation includes any combination of such characteristics or elements.

In yet another embodiment, the food protection device 100 comprises a plurality of indicia 406. The body component 102 of the device 100 may include advertising, a trademark, or other letters, designs, or characters, printed, painted, stamped, or integrated into the body component 102, or any other indicia 406 as is known in the art. Specifically, any suitable indicia 406 as is known in the art can be included, such as, but not limited to, patterns, logos, emblems, images, symbols, designs, letters, words, characters, animals, advertisements, brands, etc., that may or may not be food, picnic, or brand related.

Figure 5:
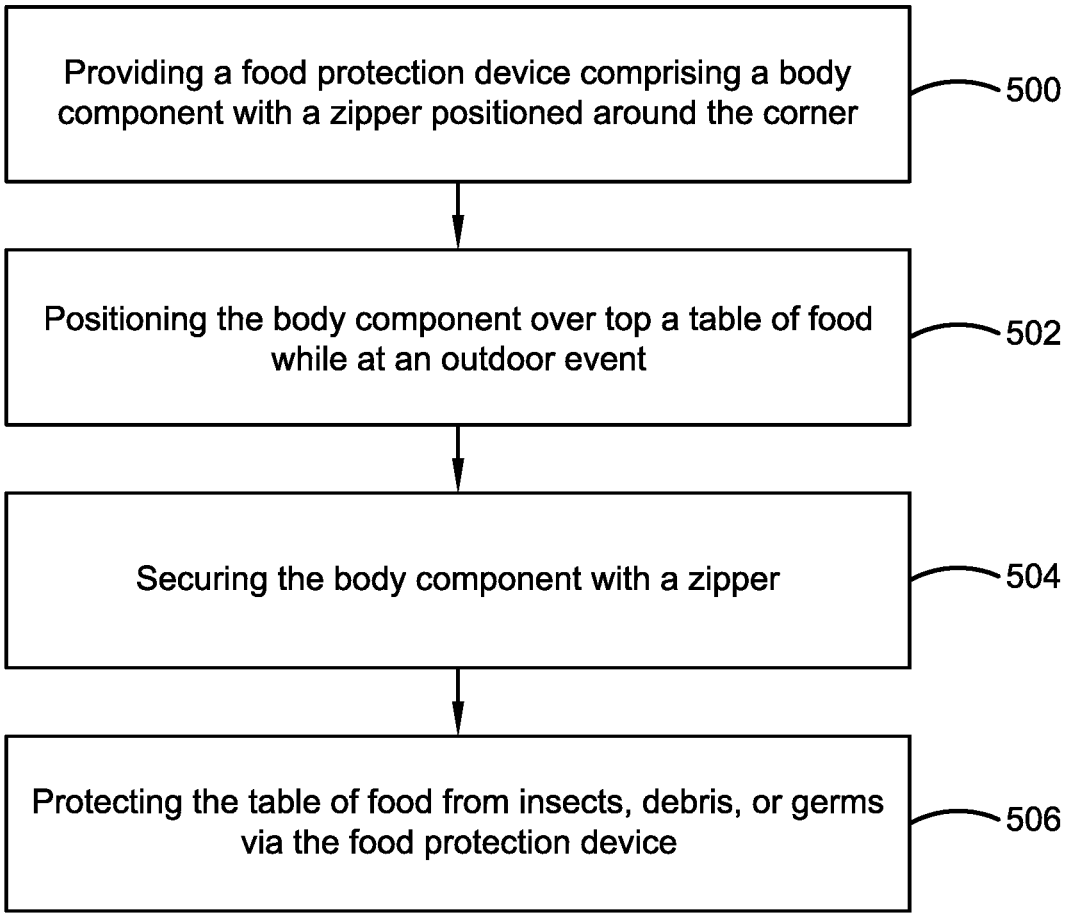
FIG. 5 illustrates a flowchart showing the method of protecting food served outdoors in accordance with the disclosed architecture.

FIG. 5 illustrates a flowchart of the method of protecting food served outdoors. The method includes the steps of at 500, providing a food protection device comprising a body component with a zipper positioned around the perimeter. The method also comprises at 502, positioning the body component overtop a table while at an outdoor event. Further, the method comprises at 504, securing the body component with the zipper. Finally, the method comprises at 506, protecting the food on the table from insects, outdoor debris, or germs via the food protection device.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "food protection device", "protection device", "cover device", and "device" are interchangeable and refer to the food protection device 100 of the present invention.

Notwithstanding the foregoing, the food protection device 100 of the present invention can be of any suitable size and configuration as is known in the art without affecting the overall concept of the invention, provided that it accomplishes the above-stated objectives. One of ordinary skill in the art will appreciate that the food protection device 100 as shown in FIGS. 1-5 is for illustrative purposes only, and that many other sizes and shapes of the food protection device 100 are well within the scope of the present disclosure. Although the dimensions of the food protection device 100 are important design parameters for user convenience, the food protection device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A food protection device that covers and protects food served outdoors, the food protection device comprising:

a body component;

wherein the body component is constructed from a flexible material;

wherein the body component comprises an exterior surface and an interior surface;

wherein the body component can be sized and shaped to be placed over a single food plate, multiple food plates, or an entire table surface;

wherein the body component is made from a pliable material or netting, a tablecloth-like material, a sheer cotton material, polyvinyl chloride, nylon, or carbon fiber;

wherein the body component is washable;

wherein the body component is weather resistant or has a weather resistant coating on the exterior surface;

wherein the body component is insulated to retain heat and keep food on the table warm longer;

wherein the body component is formed from two layers of pliable material secured together, an outer layer and an inner layer; and further wherein the body component is placed over a table and secured to protect food on the table from insects, debris, or weather.

2. The food protection device of claim 1, wherein the body component is configured in a circular shape.

3. The food protection device of claim 1, wherein the body component is configured in a rectangular shape.

4. The food protection device of claim 1, wherein the outer layer is constructed of a water-resistant fabric, while the inner layer is constructed of an insulated fabric.

5. The food protection device of claim 1, wherein the body component is wind resistant and a perimeter of the body component comprises small weights or clamp members for securing the body component to a table surface.

6. The food protection device of claim 5, wherein the perimeter of the body component comprises a zipper component for securing the body component around the table.

7. The food protection device of claim 6, wherein the body component comprises a plurality of rigid members which are positioned on the interior surface, which maintains the body component in a curved shape away from the food on the table.

8. The food protection device of claim 7, wherein the plurality of rigid members comprise a set of legs and semicircular ribs secured to the interior surface to provide form and protection for the body component.

* * * * *